US006591799B1

(12) United States Patent
Hase et al.

(10) Patent No.: US 6,591,799 B1
(45) Date of Patent: Jul. 15, 2003

(54) VALVE TIMING ADJUSTING DEVICE

(75) Inventors: Hirofumi Hase, Tokyo (JP); Katsuyuki Fukuhara, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/070,638

(22) PCT Filed: Jul. 10, 2000

(86) PCT No.: PCT/JP00/04605

§ 371 (c)(1),
(2), (4) Date: Mar. 11, 2002

(87) PCT Pub. No.: WO02/04789

PCT Pub. Date: Jan. 17, 2002

(51) Int. Cl.[7] ..... F01L 1/34
(52) U.S. Cl. ..... 123/90.17; 123/90.15; 123/90.18
(58) Field of Search ..... 123/90.17, 90.15, 123/90.18

(56) References Cited

U.S. PATENT DOCUMENTS 5,234,088 A * 8/1993 Hampton ..... 192/44
6,155,219 A 12/2000 Fukuhara et al.
6,276,321 B1 * 8/2001 Lichti et al. ..... 123/90.17

FOREIGN PATENT DOCUMENTS

| | | |
|---|---|---|
| JP | 1-92504 | 4/1989 |
| JP | 8-121122 | 5/1996 |
| JP | 9-60507 | 3/1997 |
| JP | 9-264110 | 10/1997 |
| JP | 9-280018 | 10/1997 |
| JP | 10-68306 | 3/1998 |

* cited by examiner

*Primary Examiner*—Thomas Denion
*Assistant Examiner*—Kyle Riddle
(74) *Attorney, Agent, or Firm*—Sughrue Mion, PLLC

(57) ABSTRACT

A valve timing control device is mounted on an end of a camshaft having a plurality of cams opening and closing an intake or exhaust valve of an internal combustion engine to modify timing for the opening and closing of the intake or exhaust valve by way of a tappet. The device includes a bias means biasing the camshaft in an advanced direction with a biasing force approximately equal to or smaller than a peak value of frictional torque produced between a cam of the camshaft and the tappet.

11 Claims, 7 Drawing Sheets

VALVE TIMING ADJUSTING DEVICE

TECHNICAL FIELD

The invention relates to a valve timing control device as a hydraulic actuator mounted on an end of a camshaft, which modifies timing for the opening and closing of both or one of intake and exhaust valves depending on conditions when an engine is operated.

BACKGROUND ART

A vane-equipped or helical piston-equipped valve timing control device is known as a conventional hydraulic valve timing control device. The device is arranged between a timing chain or chain sprocket and a camshaft, the timing chain or chain sprocket defined as a valve-driving system rotating in synchronization with a crankshaft of an engine to drive the camshaft. Oil derived from an oil pump is controllably supplied to the valve timing control device and discharged to outside, by way of an oil control valve (hereafter, referred as an OCV). In this way, it is possible to modify relatively angular displacements of the camshaft with respect to those of the crankshaft. When the angular displacement of the camshaft is variably controlled in advanced or retarded direction, it is possible to optimize timing for the opening and closing of an intake or exhaust valve depending on the number of revolutions and loads of the engine. As a result, it is possible to reduce exhaust gas, to improve power and to increase gas mileage.

An actuator known as the hydraulic valve timing control device includes the vane-equipped and the helical piston-equipped devices. In the vane-equipped device, a plurality of hydraulic chambers is comprised of a vane-equipped rotor and a housing element accommodating the rotor and allowing rotation in a required range. Oil derived from the oil pump is controllably supplied to the hydraulic chambers and discharged to the outside, by way of the OCV. In this way, the hydraulic pressure is changed to shift angular displacement of the camshaft with respect to the crankshaft to advanced or retarded position. On the other hand, the helical piston-equipped device includes a first helical gear formed at a hydraulic piston moved reciprocally in an axial direction due to a hydraulic pressure derived from the OCV and a second helical gear engaged with the first helical gear. These gears are rotated in a required range on the basis of twisting of a helical spline in a housing element. In this way, it is possible to shift angular displacement of the camshaft with respect to the crankshaft to advanced or retarded position. In either case, timing for the opening and closing of an intake or exhaust valve is controlled due to the hydraulic pressure. For example, JP-A-92504/1989, JP-A-121122/1996, JP-A-60507/1997 and JP-A-280018/1997 are known as the former vane-equipped valve timing control device.

Especially, with an exhaust valve timing control device, a driving force derived from a crankshaft of the engine however exerts a force in lo a retarded direction on a camshaft. Moreover, at a time when the engine is started and so on, a pump of the engine is not yet actuated, and the hydraulic pressure is not functioned. Under the conditions, with the conventional device, the camshaft is rotated in the retarded direction when normal advance control cannot be performed due to the force in the same direction. As a result, timing for the opening of the exhaust valve is delayed to lead instability of idling such as a deterioration of starting characteristics of the engine. To solve the problems, a biasing means is arranged in the valve timing control device.

Under the conditions of the engine that the hydraulic pressure is not functioned at a time when the engine is started, the biasing means biases the camshaft in the advanced direction against the force in the retarded direction exerted on the camshaft by the driving force derived from the crankshaft. In this way, the engine is started with stability. For example, JP-A-68306/1998 and JP-A-264110/1997 are concerned with the conventional device above.

The former gazette JP-A-68306/1998 discloses a device including a rotor rotatable in synchronization with a camshaft, a biasing means biasing the rotor to rotate a camshaft in an advanced direction with respect to a crankshaft, and a lock mechanism which allows to lock the rotor. With the device, the biasing force of the biasing means is set to be larger than the maximum torque on starting the engine and be larger than an average torque.

The latter gazette JP-A-264110/1997 discloses a device including a vane constituting a plurality of hydraulic chambers formed at inner peripheral sections of the device, and a biasing means biasing a camshaft so as to avoid opening both intake and exhaust valves at the same time. With the device, the biasing force of the biasing means is set to be smaller than a hydraulic pressure supplied to and discharged from the hydraulic chambers. When the hydraulic pressure is reduced, the biasing means also biases the camshaft in advanced direction.

FIG. 1 is a radial or lateral cross sectional view of an internal structure o f a vane-equipped device disclosed in the gazette JP-A-68306/1998. In the drawing, a reference numeral 100 denotes a shoe-equipped housing defined as a driving force transferring member and 101 denotes a vane-equipped rotor defined as the driving force transferring member rotatably arranged in a required range of the shoe-equipped housing 100. Shoes 100*a*, 100*b* and 100*c* projected inwardly in a radial direction are arranged at an inner peripheral section of the shoe-equipped housing 100. Vanes 101*a*, 101*b* and 101*c* projected outwardly in the radial direction are arranged at an outer peripheral section of the vane-equipped rotor 101. The shoes 100*a*, 100*b* and 100*c* and the vanes 101*a*, 101*b* and 101*c* partition a space between the shoe-equipped housing 100 and the vane-equipped rotor 101 into a plurality of rotor-retarding side hydraulic chambers 102, 103 and 104 and rotor-advance side hydraulic chambers 105, 106 and 107. Recesses 108 are formed at the shoes 100*a*, 100*b* and 100*c* facing the rotor-advance side hydraulic chambers 105, 106 and 107, respectively. Recesses 109 are formed at the vanes 101*a*, 101*b* and 101*c* facing the rotor-retarding side hydraulic chambers 102, 103 and 104, respectively. In each rotor-advance side hydraulic chamber 105, 106 or 107, spring members 110 defined as a biasing means are arranged between both recesses 108 and 109. The shoe-equipped housing 100 is mounted rotatably on an exhaust camshaft corresponding to the exhaust valve and the vane-equipped rotor 101 is fixedly joined at an end of the exhaust camshaft with bolts so as to be rotated in synchronization with the exhaust camshaft.

Next, an operation will be explained.

First, a rotational driving force derived from a crankshaft (not shown) of the engine is transferred to the exhaust camshaft (not shown) by way of a timing chain or timing belt (hereafter, a driving force transferring means, not shown in either of the cases), the shoe-equipped housing 100 and the vane-equipped rotor 101 having a chain sprocket (not shown) or a timing chain (not shown) and defined as a driving force transferring member.

When the valve timing control device is actuated, the vane-equipped rotor 101 is rotated relative to the crankshaft 1 at a required angle due to a hydraulic pressure derived from the OCV (not shown). In this way, since the exhaust camshaft, which is rotated in synchronization with the vane-equipped rotor 101, is rotated relative to the crankshaft, it is possible to control timing for the opening and closing of the exhaust valves (not shown).

Since the conventional valve timing control device has the construction as described above, there are problems as follows.

(1) That is, as disclosed in the JP-A-68306/1998, a biasing force of the spring 110, which is defined as the biasing means biasing the camshaft in the advanced direction, is set to be larger than the maximum torque on starting the engine or an average torque. The size of the spring 110 generating such a large biasing force must be large. It is therefore difficult to insert actually the large spring 110 into the hydraulic chamber of the valve timing control device arranged within a confined space of the engine.

(2) Since the biasing force in the advanced direction is very large, the valve timing control device defined as an actuator has two remarkable different-operation speeds between in the advanced and retarded directions, which is not negligible. The operation speed in the advanced direction can be increased due to the excess biasing force in the advanced direction, but the operation speed in the retarded direction is extremely reduced. Control characteristic of the valve timing control device becomes worse and the excess biasing force has effect, which is not negligible, on performance capabilities of the engine.

(3) Moreover, since the biasing force is very large it is difficult to perform an assembling work assembling the biasing means into the valve timing control device while controlling the biasing force. Since a rotor, which is rotated in synchronization with the camshaft, is subjected to the excess force after the assembling work, concerns are rising that the rotor is pinched.

The invention was made to solve the foregoing problems. Accordingly, it is an object of the invention to provide a valve timing control device as follows. If a case is not engaged with a rotor under conditions that an engine is stopped, it is possible to perform the engagement above at the most advanced position during one-turn of the camshaft on cranking. In this way, it is possible to prevent a deterioration of starting characteristics of the engine. At the same time, it is possible to prevent response speed differentials occurred by the biasing means biasing the camshaft in the advanced direction in the conventional device and to start the engine with stability.

DISCLOSURE OF THE INVENTION

In order to achieve the object of the invention, a valve timing control device mounted on an end of a camshaft having a plurality of cams opening and closing an intake or exhaust valve of an internal combustion engine to modify timing for the opening and closing of the intake or exhaust valve by way of a tappet, comprises a bias means biasing the camshaft in an advanced direction with a biasing force approximately equal to or smaller than a peak value of frictional torque produced between a cam of the camshaft and the tappet. In this way, since response speed differentials, which occur between the advanced and retarded directions due to the oversized biasing force in the conventional device, do not occur. Therefore, it is possible to prevent the deterioration of the control characteristics of the valve timing control device.

With the above arrangement, the device per se may be mounted on the camshaft corresponding to an exhaust valve of the internal combustion engine. In this way, it is possible to bias the exhaust camshaft in the advanced direction against the frictional force produced by the rotation of the cam.

With the above arrangement, the biasing force of the biasing means may be set to approximately equal to or larger than the frictional torque when an axial torque reaches a peak, the axial torque defined as a synthetic torque synthesized from the frictional torque and a cam torque being determined by a cam profile. In this way, it is possible to cancel out the frictional torque in the contact section that the rotor comes into contact with the case element at the most advanced position and to prolong the contact section.

With the above arrangement, the biasing force of the biasing means may be set to approximately equal to or larger than the frictional torque when a cam torque reaches a peak, the cam torque being determined by a cam profile. In this way, it is possible to cancel out the frictional torque in the contact section that the rotor comes into contact with the case element at the most advanced position and to prolong the contact section.

With the above arrangement, the biasing force of the biasing means may be set to approximately equal to or smaller than a peak value of the frictional torque in the range of the number of revolutions of the engine from just after cranking of the engine is started to running at stable idle, and set to approximately equal to or larger than the frictional torque when an axial torque or a cam torque reaches a peak, the axial torque defined as a synthetic torque synthesized from the frictional torque and the cam torque being determined by a cam profile. In this way, since the biasing force can be determined in the range of the number of revolutions of the engine when the maximum frictional torque is obtained, it is possible to prolong the contact section comparable to the most advanced position on starting the engine.

With the above arrangement, the number of cylinders targeted for control per a camshaft of the internal combustion engine may be three or less. Further, the biasing force of the biasing means is set to approximately equal to or smaller than the peak value of the frictional torque and is set to approximately equal to or larger than the frictional torque when the axial or cam torque reaches the peak value. In this way, since the biasing force of the biasing means can be determined depending on the frictional torque, the cam torque and the axial torque with respect to one cam, it is possible to construct a device having versatility with respect to various engines.

With the above arrangement, the number of cylinders targeted for control per a camshaft of an internal combustion engine may be four or five. Further, the biasing force of the biasing means is set to approximately equal to or smaller than the peak value of the frictional torque and is set to approximately equal to or larger than the frictional torque when the axial or cam torque reaches the peak value. In this way, since the biasing force of the biasing means can be determined depending on the frictional torque, the cam torque and the axial torque with respect to one cam, it is possible to construct a device having versatility with respect to various engines.

With the above arrangement, the number of cylinders targeted for control per a camshaft of the internal combustion engine maybe six. Further, the biasing force of the biasing means is set to approximately equal to or smaller than the peak value of the frictional torque and is set to approximately equal to or larger than the frictional torque when the axial or cam torque reaches the peak value. In this way, since the biasing force of the biasing means can be determined depending on the frictional torque, the cam torque and the axial torque with respect to one cam, it is possible to construct a device having versatility with respect to various engines.

With the above arrangement, it may further comprise a housing element having a driving force transferring means transferring a driving force from a crankshaft of the internal combustion engine to the camshaft; a rotor element fixed mounted on an end of the camshaft so as to be rotated in synchronization with the camshaft and having a plurality of vanes projected outwardly from an outer peripheral section of a boss in a radial direction of the boss; and a case element fixedly mounted on the housing element and having a plurality of shoes projected inwardly from an inner peripheral section of the case, wherein the shoes constitute a plurality of hydraulic chambers in cooperation with the vanes of the rotor element. In this way, it is possible to construct the simple device as compared with the helical piston-equipped device and to extensively reduce the cost to manufacture the device.

With the above arrangement, it may further comprise at least one biasing means, which is arranged within at least one of the hydraulic chambers comprised of the vanes of the rotor element and the shoes of the case element. In this way, it is possible to down size the device and there is a merit of allowing mounting it on various engines.

With the above arrangement, it may further comprise a lock member mating with the rotor element during a period when the rotor element comes into contact with the case element at the most advanced position due to the biasing force of the biasing means and locking the rotor element at the most advanced position. In this way, since the rotor is locked just after cranking is started on starting the engine, it is possible to prevent abnormal noise or vibration from occurring and to ensure the starting characteristics of the engine with stability.

BEST MODES FOR CARRYING OUT THE INVENTION

To explain the invention more in detail, the best modes of carrying out the invention will be described with reference to the accompanying drawings.

EMGODIMENT 1

Figure 1:
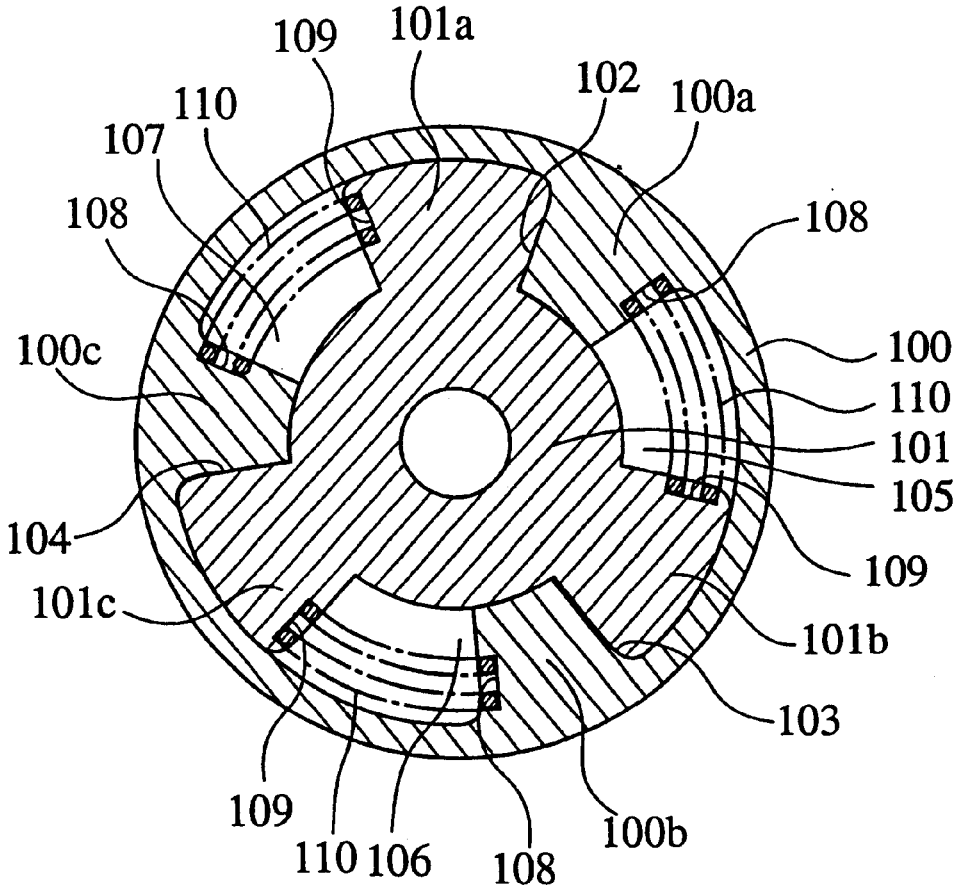
FIG.1 PRIOR ART
FIG. 1 is a radial or lateral cross sectional view of an internal structure of a conventional hydraulic valve timing control device.
Figure 2:
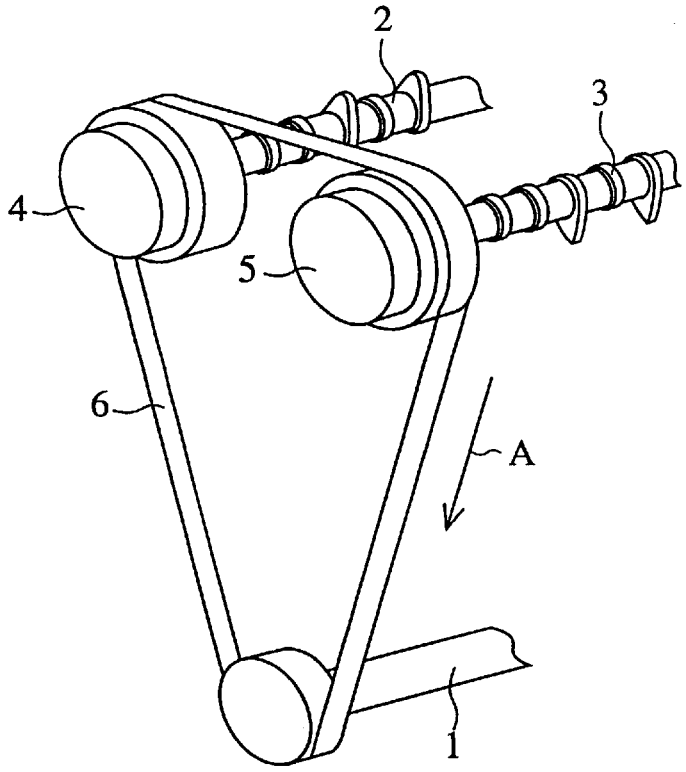
FIG. 2 is a perspective, front side view of an engine provided with a valve timing control device as embodiment 1 according to the invention.
Figure 3:
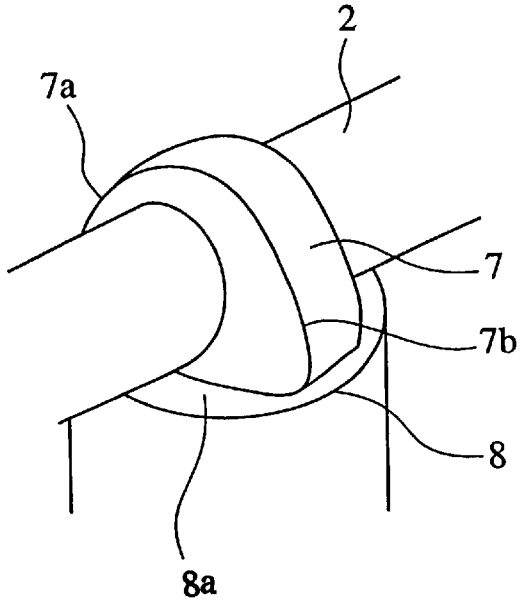
FIG. 3 is an enlarged perspective view of a camshaft shown in FIG. 2.

FIG. 2 is a perspective, front side view of an engine provided with a valve timing control device as embodiment 1 according to the invention, and FIG. 3 is an enlarged perspective view of a camshaft shown in FIG. 2. In these drawings, a reference numeral 1 denotes a crankshaft of an engine (not shown), a reference numeral 2 denotes an exhaust camshaft, and a reference numeral 3 denotes an intake camshaft. A reference numeral 4 denotes an exhaust valve timing control device fixedly mounted at an end of the exhaust camshaft 2 with bolts (not shown). A reference numeral 5 denotes an intake valve timing control device fixedly mounted at an end of the intake camshaft 3 with bolts (not shown). A reference numeral 6 denotes a timing chain or timing belt (hereafter, referred as a driving force transferring means) transferring a rotational driving force derived from the crankshaft 1 to the exhaust camshaft 2 and the intake camshaft 3. The driving force transferring means 6 is rotatable in a direction indicated by an arrow A of FIG. 2 in response to the rotation of the crankshaft 1.

Plural cams 7 are mounted on the exhaust camshaft 2 to be integrated in to the exhaust camshaft 2. As for the point above, since the in take camshaft 3 is exactly alike, the exhaust camshaft 2 is explained as a representative example and the explanation of the intake camshaft 3 will be omitted. Each cam 7 is comprised of a base-circle section 7*a* arranged co-axially at the exhaust camshaft 2 and a geometric shape section 7*b* formed at a part of the base-circle section 7*a*. Each cam 7 comes into contact with an upper face section 8*a* of a tappet 8 one-on-one with the cam 7. The tappet 8 is movable reciprocally in a vertical direction in synchronization with an exhaust valve (not shown) by way of a valve spring (not shown).

Here, when the exhaust camshaft 2 is rotated due to the driving force derived from the crankshaft 1, the cam 7 presses the tappet 8 down by a valve lift stroke obtained depending on the shape of the geometric shape section 7*b*. After the tappet 8 is pressed down, the valve spring (not shown) is compressed and the exhaust valve (not shown) is opened against load of the valve spring (not shown) defined as stress with respect to the compression force above. When the base-circle section 7*a* of the cam 7 comes into contact with the upper face section 8*a* of the tappet 8 and the exhaust valve (not shown) is closed, the tappet 8 undergoes the load of the valve spring (not shown). At this time, work (torque) of the exhaust camshaft 2 undergoing the load of the valve spring includes, in actual, a cam torque (Tc) determined by total geometric shape (cam profile) of the cam 7 and the load of the valve spring, and a frictional torque (Tm) generated by sliding the cam 7 over the tappet 8. These two kinds of torque are indicated by the following equations (I) and (II), for example.

$$Tm=uFy \quad \text{(I)}$$

$$Tc=Fx \quad \text{(II)}$$

In the equations (I) and (II), the mark u denotes the coefficient of friction between the cam and the tappet. The mark F denotes the load of the valve spring (F=ky'). The mark y denotes the distance of point of application of the frictional torque in a vertical direction (y=Rb+y', here the mark Rb denotes a radius of the base-circle section of the cam.) Moreover, the mark x denotes the distance of point of application of the cam torque in a horizontal direction, the mark k denotes the valve spring constant and the mark y' denotes the valve lift stroke.

Figure 4:
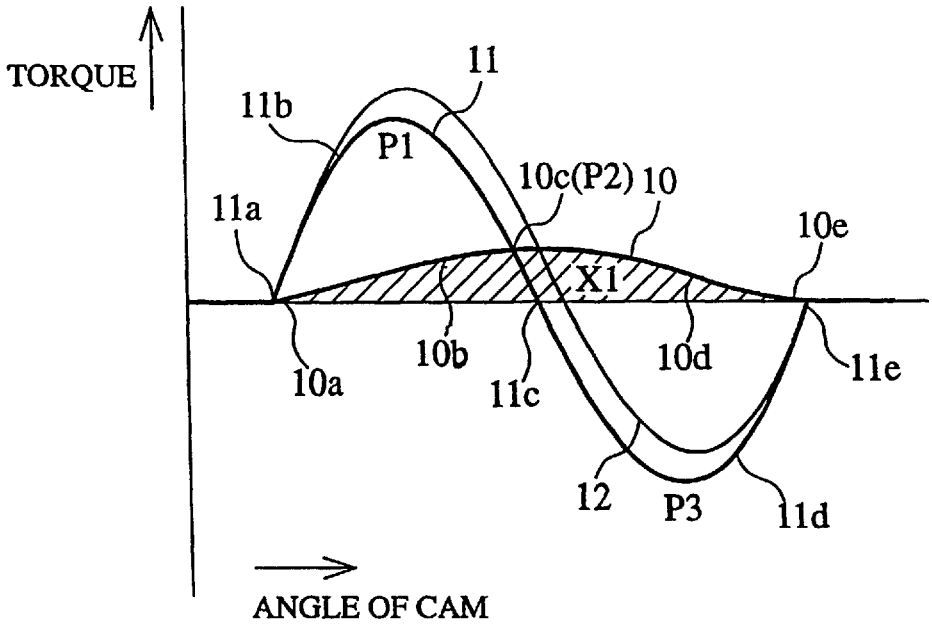
FIG. 4 is a graph of a torque curve of a frictional torque or a cam torque, which varies with respect to angle of cam.

FIG. 4 is a graph of variations of the frictional torque (Tm) and the cam torque (Tc), which are generally indicated by the equations (I) and (II), for example, with respect to angle of cam.

Hereafter, variations of each torque due to the rotation of the exhaust camshaft 2 will be explained with reference to FIG. 4. In the drawing, a reference numeral 10 denotes a frictional torque curve, and a reference numeral 11 denotes a cam torque curve. A section, that the base-circle section 7*a* of the cam 7 shown in FIG. 2 and FIG. 3 comes into contact with the upper face 8*a* of the tappet 8, corresponds with the closing of the exhaust valve (not shown). Under the condition, it is set to minimize a contact pressure between the cam 7 and the tappet 8. Therefore, since the cam 7 almost does not undergo the load of the valve spring, both the frictional torque (Tm) and the cam torque (Tc) are nearly equal to zero (torque (Ts) with respect to the load when the valves are mounted on the device. The cam 7 then starts riding on the tappet as the exhaust camshaft 2 is further rotated. At this time, both the frictional torque (Tm) and the cam torque (Tc) start increasing in a positive direction (positions indicated by 10*a* on the frictional torque curve 10 and 11*a* on the cam torque curve 11). Both the frictional torque (Tm) and the cam torque (Tc) increase so as to create an approximately sine wave (sections indicated by 10*b* on the frictional torque curve 10 and 10*b* on the cam torque curve 11). The cam torque (Tc) reaches a positive peak value P1 in the section 11*b*. The top of the geometric shape section 7*b* of the cam 7 comes into contact with the tappet 8 (positions indicated by 10*c* on the frictional torque curve 10 and 11*c* on the cam torque curve 11) to obtain the maximum valve lift stroke of the exhaust valve (not shown). Likewise, the load of the valve spring also reaches the peak. The frictional torque (Tm) reaches a peak value P2 and the cam torque (Tc) becomes zero. When a part beyond the top of the geometric section 7*b* of the cam 7 starts coming into contact with the tappet 8 (sections indicated by 10*d* on the frictional torque curve 10 and 11*d* on the cam torque curve 11), the frictional torque (Tm) decreases in the positive range (region X1). On the other hand, the cam torque (Tc) indicates a negative value and reaches a negative peak value P3 in the section 10*d*. Then, the cam 7 is kept from contact with the tappet 8 and both the frictional torque (Tm) and the cam torque (Tc) becomes zero (positions indicated by 10*e* on the frictional torque curve 10 and 11*e* on the cam torque curve 11).

Torque, which is exerted on the cam 7 as the exhaust camshaft 2 is rotated, varies as described above. An axial torque (Tt), which is defined as a synthetic torque synthesized from the frictional torque (Tm) and the cam torque (Tc), is actually observed. Here, the axial torque (Tt) is defined as a load torque due to the valve spring indicated by the following equation (III). That is, $$Tt=Tm+Tc+Ts \quad \text{(III)}$$

Here, the mark Ts means a torque-with respect to the load when the valves are mounted on the device. When the Ts is equal to zero, the axial torque (Tt) is indicated by the synthetic torque synthesized from the frictional torque (Tm) and the cam torque (Tc) as described above. The synthetic torque is created as an axial torque curve 12 shown in FIG. 4.

Figure 5:
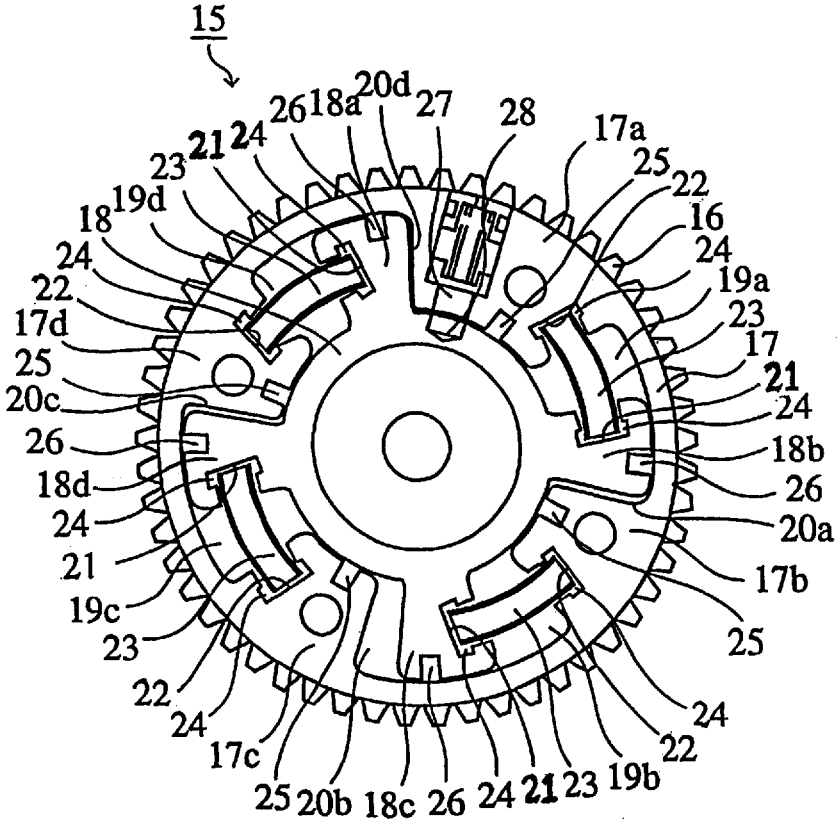
FIG. 5 is a radial or lateral cross sectional view of the hydraulic valve timing control device mounted on the engine shown in FIG. 2.
Figure 6:
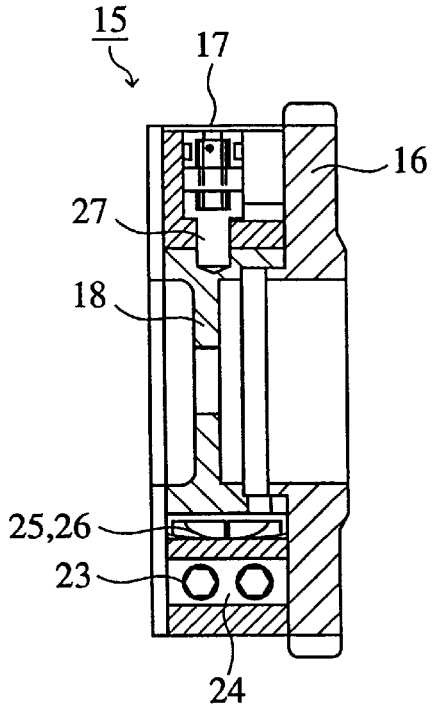
FIG. 6 is an axial or longitudinal cross sectional view of the hydraulic valve timing control device shown in FIG. 5.

FIG. 5 is a radial or lateral cross sectional view of the hydraulic valve timing control device mounted on the engine shown in FIG. 2, and FIG. 6 is an axial or longitudinal cross sectional view of the hydraulic valve timing control device shown in FIG. 5. In the drawings, a reference numeral 15 denotes a hydraulic actuator controlling timing for the opening and closing of the exhaust valve (not shown). The actuator 15 is integrally provided with a chain sprocket or timing chain (hereafter, referred as a driving force transferring member) transferring a rotational driving force, which is derived from the crankshaft 1 through the driving force transferring means 6, to the exhaust camshaft 2. The actuator 15 includes a housing element 16, a case element 17 and a rotor 18. The housing element 16 is rotatably mounted on the exhaust camshaft 2. The case element 17 is rotated in synchronization with the housing element 16 and has a plurality of shoes 17*a*, 17*b*, 17*c* and 17*d*, each of them being projected inwardly from an inner periphery of the case element 17 in a radial direction thereof. The rotor 18 is fixedly mounted on an end of the exhaust camshaft 2 with bolts and has a plurality of vanes 18*a*, 18*b*, 18*c* and 18*d*, each of them being projected outwardly from an outer periphery of the rotor 18 in a radial direction thereof. Plural rotor-advance side hydraulic chambers 19*a*, 19*b*, 19*c* and 19*d* and rotor-retarding side hydraulic chambers 20*a*, 20*b*, 20*c* and 20*d* are constructed between the shoes 17*a*, 17*b*, 17*c* and 17*d* of the case element 17 and the vanes 18*a*, 18*b*, 18*c* and 18*d* of the rotor 18. A hydraulic pressure derived from the OCV (not shown) is supplied to the chambers. Two kinds of recesses 21 and 22 are formed at the shoes 17*a*, 17*b*, 17*c* and 17*d* of the case element 17 and the vanes 18*a*, 18*b*, 18*c* and 18*d* of the rotor 18, which constitute the rotor-advance side hydraulic chambers 19*a*, 19*b*, 19*c* and 19*d*, respectively. Elastic members 23 defined as the advanced biasing means are disposed between both of the recesses 21 and 22 in a peripheral direction of the case element 17 and the rotor 18. Both ends of the elastic member 23 are supported by a holder 24 disposed in the recesses 21 and 22. With the embodiment 1, each of rotor-advance side hydraulic chambers 19*a*, 19*b*, 19*c* and 19*d* contains one elastic member 23. Alternatively, plural elastic members 23 may be disposed in each chamber.

A reference numeral 25 denotes a seal member, which is arranged at a front end of each shoe of the case element 17 and comes into contact with the outer periphery of the rotor 18 to seal between adjacent hydraulic chambers. A reference numeral 26 denotes a seal member, which is arranged at a front end of each vane of the rotor 18 and comes into contact with the inner periphery of the case element 17 to seal between adjacent hydraulic chambers.

A reference numeral 27 denotes a lock member arranged movably in a radial direction in the shoe 17*a* of the case element 17. A reference numeral 28 denotes a mating hole formed at the outer periphery of a boss section of the rotor 18 to allow mating with the lock member 27. The lock member 27 and the mating hole 28 constitute a lock mechanism locking a rotation of the case element 17 and the rotor 18 when the rotor 18 locates at the most advanced position.

The rotational driving force derived from the crankshaft 1 is transferred through the driving force transferring means 6 to the housing element 16 in the exhaust valve timing control device 4 as constructed above. In this way, the housing element 16 is rotatable in synchronization with the crankshaft 1. With the exhaust valve timing control device 4, the rotor 18 rotatable in synchronization with the exhaust camshaft 2 is rotated relative to the crankshaft 1 in a required range and phase shift of the exhaust camshaft 2 with respect to the crankshaft 1 occurs. In this way, it is possible to advance or retard timing for the opening and closing of the exhaust valve (not shown).

Next, changes on the axial torque curve 12 shown in FIG. 4 will be explained with reference to FIG. 7, in connection with the function of each component in the valve timing control device shown in FIG. 5.

Figure 7:
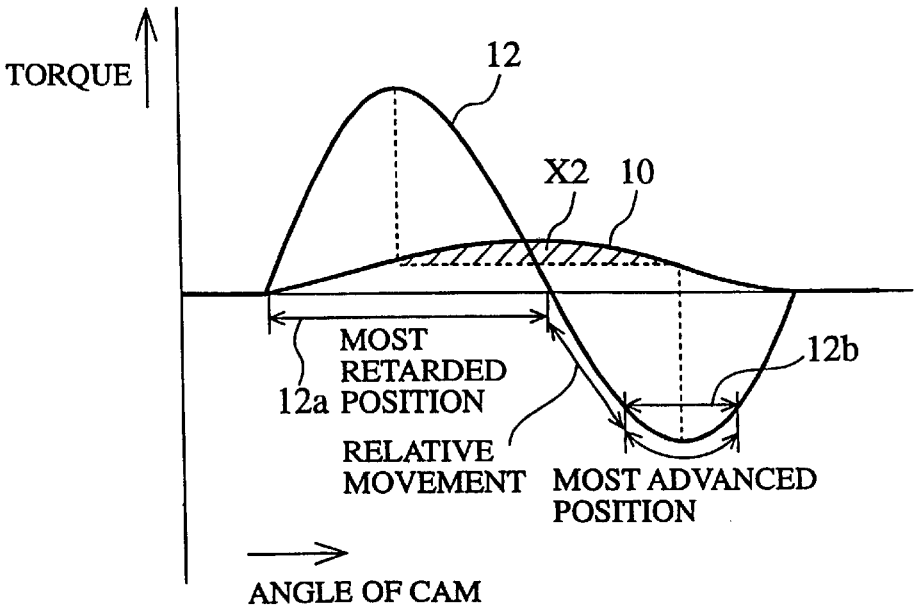
FIG. 7 is a graph of torque curves of the frictional torque and the axial torque when the hydraulic valve timing control device of FIG. 2 to FIG. 6 is used.

FIG. 7 is a graph of torque curves of the frictional torque and the axial torque when the hydraulic valve timing control device of FIG. 2 to FIG. 6 is used. In FIG. 7, the reference numeral 10 denotes the frictional torque curve and the reference numeral 12 denotes the axial torque curve. In the section 12*a* of the axial torque curve 12 varying while the axial torque indicates the positive value, the cam shown in FIG. 3 rides on the tappet 8 to compress the valve spring (not shown). The exhaust camshaft 2 shown in FIG. 2 and the rotor 18 in the exhaust valve timing control device 4 undergo a force in the retarded direction due to the frictional torque and the cam torque. The rotor 18 further comes into contact with the shoes of the case element 17 controlling that the rotor 18 is rotatable in a required angle. The contact section 12*a* is comparable to the most retarded position of the rotor 18 with respect to the case element 17. Next, when exhaust camshaft 2 is further rotated and the part beyond the top of the cam 7 comes into contact with the tappet 8, the axial torque becomes zero. The axial torque indicates a negative value immediately afterward. The exhaust camshaft 2 and the rotor 18 in the valve timing control device 4 undergo the force in the advanced direction and the rotor 18 starts rotating from the most retarded position in the advanced direction. When the axial torque decreases below a negative value, the rotor 18 comes into contact with the case element 17 at the most advanced position. The contact section comparable to the most advanced position is indicated by a reference numeral 12*b*, and the rotor 18 comes into contact with the case element 17 at the most advanced position only when the axial torque decreases below a negative value as shown in the drawings. When the contact section 12*b* comparable to the most advanced position is passed, the rotor 18 starts rotating from the most advanced position in the retarded direction.

The rotor 18 in the exhaust valve timing control device 4 exhibits behavior as described above as the axial torque varies. The contact section 12*b* comparable to the most advanced position will be further explained in detail. In the contact section 12*b* comparable to the most advanced position, the axial torque (Tt) can decompose into the frictional torque (Tm) and the cam torque (Tc). The cam torque (Tc) functions in the advanced direction and the frictional torque (Tm) functions in the retarded direction. Therefore, the frictional torque (Tm) interferes with the contact between the rotor 18 and the case element 17 at the most advanced position.

In order to start the engine with stability defined as one of the objects of the invention, the lock member 27 must be mated with the mating hole 28 of the rotor 18 at the number of revolutions just after cranking is started, during the contact section 12*b* above. The contact section 12*b* comparable to the most advanced position is however shortened to a considerable degree, and the contact section 12*b* must be prolonged in order to ensure that the lock member 27 is mated with the mating hole 28 of the rotor 18. Therefore, it is necessary to dispose the elastic means 23 biasing the rotor 18 and the exhaust camshaft 2 in the advanced direction. Hereafter, a method for setting the biasing force will be explained.

As described above, the frictional torque (Tm) functions in the retarded direction in the contact section 12*b* and interferes with the contact between the rotor 18 and the case element 17 at the most advanced position. Thus, it is necessary to set the biasing force in order to bias the exhaust camshaft 2 and the rotor 18 in the advanced direction, canceling out the frictional torque (Tm) in the contact section 12*b*. That is, the elastic means 23 must cancel out at least the work of the frictional torque (Tm) in the contact section 12*b*. The biasing force of the elastic means 23 must be set to a force larger than the frictional torque (Tm) when the axial torque (Tt) reaches a peak value. When the biasing force of the elastic means 23 is oversized, the control characteristic of the valve timing control device becomes worse. In this way, the maximum of the biasing force is set to the peak value of the frictional torque (Tm).

Figure 8:
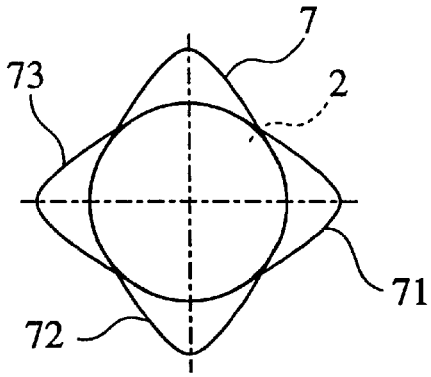
FIG. 8 is a front view of a focused image of cams mounted on a camshaft of an engine having hour cylinders targeted for control per a camshaft.
Figure 9:
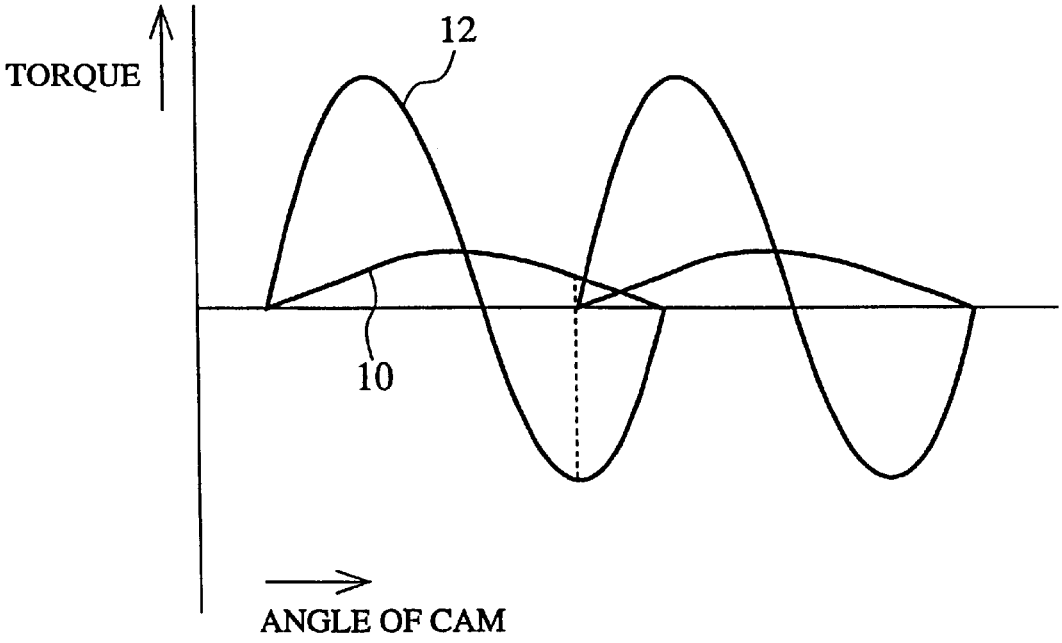
FIG. 9 is a graph of torque curves of the frictional torque and the axial torque of the engine having four cylinders targeted for control per a camshaft.

It is assumed that an engine having four or five cylinders targeted for control per a camshaft of the engine is used. FIG. 8 shows a focused image of cam mounted on the camshaft having four cylinders targeted for control per a camshaft. In the drawing, reference numerals 7, 71, 72, and 73 denote four cams, respectively. With the engine having four cylinders targeted for control per a camshaft, the cam rides on the tappet at each angle of 90 degrees (generally, 360 degrees/n; the mark n denotes the number of the cylinders of the engine). As seen from the focused image of the four cams shown in FIG. 8, the four cams are overlapped (interfered), one to the other. When such a camshaft is rotated, the frictional torque curve and the axial torque curve shown in FIG. 9 are interfered with respect to each other. Here, when the cam has an angle of 120 degrees or less, the biasing force is set to a value corresponding to the frictional torque when the axial torque reaches a peak value according to the method for setting the biasing force of the invention. Since the angle of the cam and the frictional torque, when the axial torque reaches a peak value, do not vary due to the interference of the cam, in actual, the setting of the biasing force may be determined only by a torque curve for a cam. On the other hand, when the cam has an angle larger than 120 degrees, the torque curves are interfered with respect to each other due to the interference of the cam and the phase shift of angle of the cam occurs when the axial torque reaches a peak value. However, according to the method for setting the biasing force of the invention, the variation of the frictional torque is approximately equal to zero due to the shift of the peak of the axial torque. In this case, likewise, the setting of the biasing force may be determined only by a torque curve for a cam.

A design, the contact pressure between the tappet and the base-circle section of the cam is not negligible, is made in the likes of the hydraulic lash-adjuster equipped valve lifter, for example. In this case, the friction torque may be offset in the positive direction by the torque or torque (Ts) with respect to the load when the valves are mounted on the device. Likewise, the method for setting the biasing force may be determined.

Moreover, when the engine has n number of valves per a cylinder, each torque value may be multiplied by the n times.

As described above, with the embodiment 1, the elastic means biasing the camshaft in the advanced direction is disposed in the vane-equipped valve timing control device. The biasing force is set to be smaller than the peak value of the frictional torque and to be larger than a force corresponding to the frictional torque when the axial torque reaches the peak value. The lock member locking the rotor at the most advanced position is disposed in the valve timing control device. In this way, if the case element is not engaged with the rotor under conditions that the engine is stopped, it is possible to perform the engagement above during one-turn of the camshaft on cranking. In this way, it is possible to prevent a deterioration of starting characteristics of the engine. At the same time, it is possible to set the biasing force more than necessary without the deterioration of the control characteristic of the valve timing control device. It is further possible to ensure the starting characteristic of the engine with stability because the contact section comparable to the most advanced position is prolonged and the lock member is mated with the rotor at the number of revolutions just after cranking is started.

Considerable force, which is produced by the rotation of the camshaft except for the friction torque and the cam torque, includes two kinds of inertial torques produced by the rotation of the camshaft and by the reciprocal movement of the tappet. The former inertial torque of the camshaft is negligible because the cam is rejected in the advanced direction just after the tappet comes into contact with a part beyond the top of the cam and then rotates with constant speed. The latter inertial torque of the tappet is produced when the tappet cannot respond to the movement of the cam due to the high-revolution of the camshaft during high-revolution conditions of the engine. Therefore, the invention neglects the two kinds of inertial torque under extremely low-revolution conditions and the explanation will be omitted.

Embodiment 2

Figure 10:
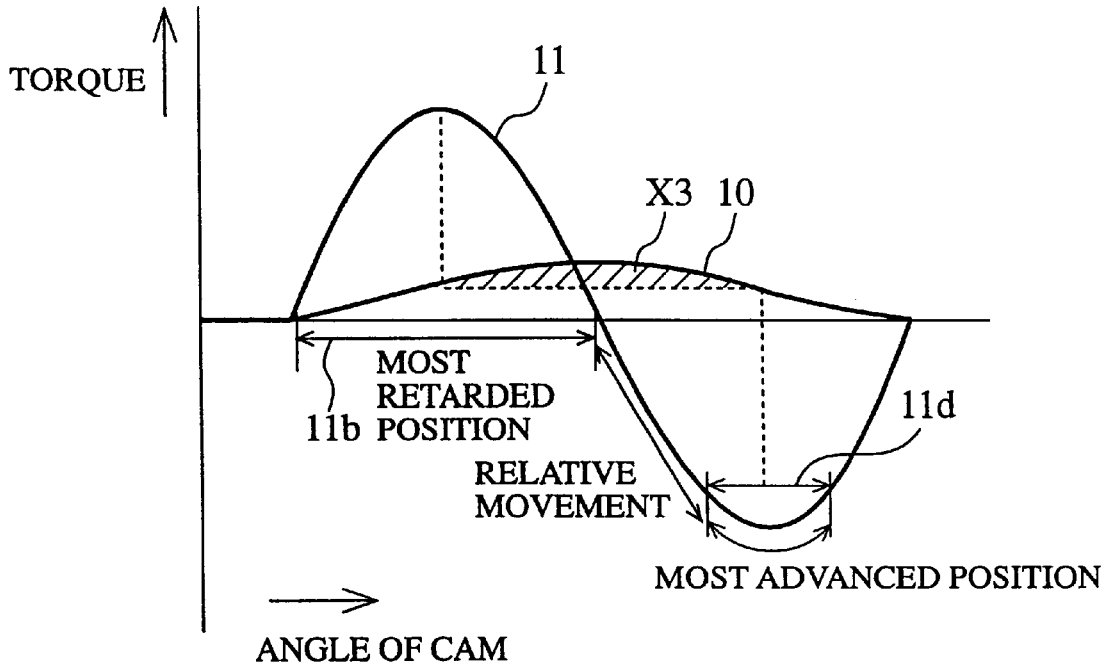
FIG. 10 is a graph of torque curves for explaining a method of setting a biasing force of an advanced biasing means in a valve timing control device as embodiment 2 according to the invention.

FIG. 10 is a graph of torque curves for explaining a method of setting a biasing force of an advanced biasing means in a valve timing control device as embodiment 2 according to the invention. Components of the embodiment 2 common to the components of the embodiment 1 are denoted by the same reference numerals and further description will be omitted. In the drawing, the reference numeral 10 denotes the frictional torque curve and the reference numeral 11 denotes the cam torque curve. In the section that the cam torque indicates a positive value, the exhaust camshaft and the rotor undergo a force in the retarded direction due to the cam torque and the frictional torque and the rotor comes into contact with the case element at the most retardation position. When the cam torque then becomes zero value and starts reaching a negative value, the rotor undergoes the force in the advanced direction which is opposite in direction to the torque. The rotor starts rotating from the most retarded position in the advanced direction due to the force exerted in the advanced direction and comes into contact with the case element at the most advanced position in a section that the cam torque reaches a negative value or less. The section comparable to the most advanced position is a section indicated by 11*d* in the drawing. When the engine is further rotated, the rotor is rotated from the most advanced position in the retarded direction.

Here, in the contact section 11*d* comparable to the most advanced position, the cam torque functions in the advanced direction and the frictional torque functions in the opposite direction. The frictional torque interferes with the contact between the rotor and the case element at the most advanced position. Thus, with the embodiment 2, the biasing means, which cancels out the frictional torque in the contact section 11*d* comparable to the most advanced position, is disposed in the device. It is further possible to ensure the starting characteristic of the engine with stability because the contact section 11*d* comparable to the most advanced position is prolonged and the lock member is reliably mated with the rotor. Therefore, since the biasing means must cancel out at least the work of the frictional torque in the contact section 11*d*, the biasing force is set to a value (region X3) larger than a value corresponding to the frictional torque when the cam torque reaches a peak value. Moreover, when the biasing force is oversize, the control characteristic of the valve timing control device becomes worse. In this way, the maximum of the biasing force is set to the peak value (region X3) of the frictional torque. As a result, it is possible to prolong the contact section comparable to the most advanced position and to mate the lock member with the rotor at the most advanced position.

As described above, according to the embodiment 2, the elastic means biasing the camshaft in the advanced direction is disposed in the vane-equipped valve timing control device. The biasing force is set to be smaller than the peak value of the frictional torque and to be larger than a force corresponding to the frictional torque when the axial torque reaches the peak value. The lock member locking the rotor at the most advanced position is disposed in the valve timing control device. In this way, it is possible to set the biasing force more than necessary without the deterioration of the control characteristic of the valve timing control device. It is further possible to ensure the starting characteristic of the engine with stability because the contact section comparable to the most advanced position is prolonged and the lock member is mated with the rotor at the number of revolutions just after cranking is started.

Embodiment 3

Figure 11:
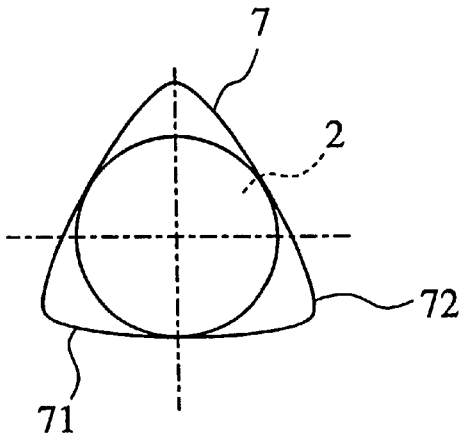
FIG. 11 is a front view of a focused image of cams mounted on a camshaft on which a valve timing control device as embodiment 3 according to the invention is mounted.

FIG. 11 shows a focused image of cams mounted on a camshaft on which a valve timing control device as embodiment 3 according to the invention is mounted. In the drawing, reference numerals 7, 71, 72 denote three cams, respectively. The number of cylinder targeted for control per a camshaft is three or less. Thus, when the number of cylinder targeted for control per a camshaft is three or less and each cam has an angle of 120 degrees or less, overlap in the cam is not present. Therefore, the consideration of one cam is good enough for setting the biasing force.

Embodiment 4

Figure 12:
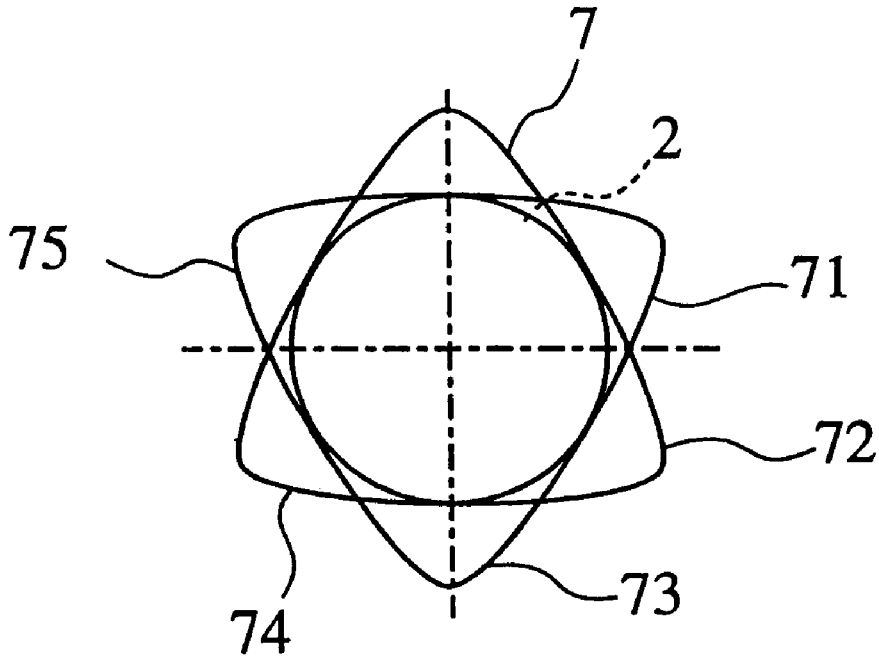
FIG. 12 is a front view of a focused image of cams mounted on a camshaft on which a valve timing control device as embodiment 4 according to the invention is mounted.

FIG. 12 shows a focused image of cams mounted on a camshaft on which a valve timing control device as embodiment 4 according to the invention is mounted. In the drawing, reference numerals 7, 71, 72, 73, 74 and 75 denote cams, respectively. The number of cylinder targeted for control per a camshaft is six. Thus, when the number of cylinder targeted for control per a camshaft is six or less and each cam has an angle of 120 degrees or less, overlap in the cam is not present. Therefore, the consideration of one cam is good enough for setting the biasing force.

INDUSTRIAL APPLICABILITY

As described above, with the valve timing control device according to the invention, if a case is not engaged with a rotor under conditions that an engine is stopped, it is possible to perform the engagement above at the most advanced position during one-turn of the camshaft on cranking. In this way, it is possible to prevent a deterioration of starting characteristics of the engine. At the same time, it is possible to prevent response speed differentials occurred by the biasing means biasing the camshaft in the advanced direction in the conventional device and to start the engine with stability. Since it is possible to determine the biasing force of the biasing means depending on frictional torque, cam torque or axial torque for each cam, the device has versatility with respect to various engines that the number of cylinders targeted for control per a camshaft is three to six.

What is claimed is:

1. A valve timing control device mounted on an end of a camshaft having a plurality of cams opening and closing an intake or exhaust valve of an internal combustion engine to modify timing for the opening and closing of the intake or exhaust valve by way of a tappet, comprising: a bias means biasing the camshaft in an advanced direction with a biasing force substantially equal to or smaller than a peak value of frictional torque produced between a cam of the camshaft and the tappet.

2. The valve timing control device according to claim 1, wherein the device per se is mounted on the camshaft corresponding to an exhaust valve of the internal combustion engine.

3. The valve timing control device according to claim 1, wherein the biasing force of the biasing means is set to substantially equal to or larger than the frictional torque when an axial torque reaches a peak, the axial torque defined as a synthetic torque synthesized from the frictional torque and a cam torque being determined by a cam profile.

4. The valve timing control device according to claim 1, wherein the biasing force of the biasing means is set to substantially equal to or larger than the frictional torque when a cam torque reaches a peak, the cam torque being determined by a cam profile.

5. The valve timing control device according to claim 1, wherein the biasing force of the biasing means is set to substantially equal to or smaller than a peak value of the frictional torque in the range of the number of revolutions of the engine from just after cranking of the engine is started to running at stable idle, and set to substantially equal to or larger than the frictional torque when an axial torque or a cam torque reaches a peak, the axial torque defined as a synthetic torque synthesized from the frictional torque and the cam torque being determined by a cam profile.

6. The valve timing control device according to claim 4, wherein the number of cylinders targeted for control per a camshaft of the internal combustion engine is three or less.

7. The valve timing control device according to claim 4, wherein the number of cylinders targeted for control per a camshaft of the internal combustion engine is four or five.

8. The valve timing control device according to claim 4, wherein the number of cylinders targeted for control per a camshaft of the internal combustion engine is six.

9. The valve timing control device according to claim 1, further comprising:

a housing element having a driving force transferring means transferring a driving force from a crankshaft of the internal combustion engine to the camshaft;

a rotor element fixed mounted on an end of the camshaft so as to be rotated in synchronization with the camshaft and having a plurality of vanes projected outwardly from an outer peripheral section of a boss in a radial direction of the boss; and a case element fixedly mounted on the housing element and having a plurality of shoes projected inwardly from an inner peripheral section of the case, wherein the shoes constitute a plurality of hydraulic chambers in cooperation with the vanes of the rotor element.

10. The valve timing control device according to claim 9, further comprising at least one biasing means, which is arranged within at least one of the hydraulic chambers comprised of the vanes of the rotor element and the shoes of the case element.

11. The valve timing control device according to claim 10, further comprising a lock member mating with the rotor element during a period when the rotor element comes into contact with the case element at the most advanced position due to the biasing force of the biasing means and locking the rotor element at the most advanced position.

* * * * *